US007011690B2

(12) United States Patent
Altvater et al.

(10) Patent No.: US 7,011,690 B2
(45) Date of Patent: Mar. 14, 2006

(54) DEVICE FOR SEPARATING LIQUID FROM A GAS CURRENT

(75) Inventors: Bernd Altvater, Althuette-Waldenweiler (DE); Dietmar Uhlenbrock, Tecklenburg (DE)

(73) Assignee: Robert Bosch GmbH, Stuttgart (DE)

( * ) Notice: Subject to any disclaimer, the term of this patent is extended or adjusted under 35 U.S.C. 154(b) by 86 days.

(21) Appl. No.: 10/481,554

(22) PCT Filed: May 8, 2003

(86) PCT No.: PCT/DE03/01475

§ 371 (c)(1),
(2), (4) Date: Dec. 19, 2003

(87) PCT Pub. No.: WO2004/042202

PCT Pub. Date: May 21, 2004

(65) Prior Publication Data

US 2004/0237484 A1 Dec. 2, 2004

(30) Foreign Application Priority Data

Nov. 8, 2002 (DE) ..... 102 51 947

(51) Int. Cl.
*B01D 45/12* (2006.01)

(52) U.S. Cl. ..... 55/312; 55/346; 55/349; 55/418; 55/DIG. 19

(58) Field of Classification Search ..... 55/343, 55/346, 349, 418, 422, 459.1, DIG. 19, 312, 55/313, 314; 96/124
See application file for complete search history.

(56) References Cited

U.S. PATENT DOCUMENTS

| | | | | |
|---|---|---|---|---|
| 3,147,099 | A * | 9/1964 | Burdock et al. | 55/344 |
| 5,947,300 | A * | 9/1999 | Lange | 209/726 |
| 6,279,556 | B1 | 8/2001 | Busen | |
| 6,684,864 | B1 | 2/2004 | Busen et al. | |
| 2003/0221398 | A1 * | 12/2003 | Trautmann et al. | 55/346 |

FOREIGN PATENT DOCUMENTS

| | | |
|---|---|---|
| DE | 197 00 733 A | 7/1998 |
| DE | 199 12 271 A1 | 9/2000 |
| DE | 199 18 311 A1 | 11/2000 |
| DE | 102 05 981 A1 | 8/2003 |

* cited by examiner

*Primary Examiner*—Robert A. Hopkins
(74) *Attorney, Agent, or Firm*—Michael J. Striker

(57) ABSTRACT

Known devices for separating liquids using parallel-connected cyclones, when gas flows are fluctuating, have a poor separating action.

In the device of the invention, the separating action is conversely improved by providing that the number of separator elements through which the gas flow flows is adapted in each case to the gas flow. When the gas flow is high, there is a flow through more separator elements than when the gas flow is low. In this way, the separator elements are operated closer to the optimal operating point than in the prior art.

According to the invention, it is proposed that a closing body (11) of a distributor valve (13) be disposed movably in a distributor conduit (10) and either automatically or by means of a drive mechanism adjusts the optimal number of separator elements (16) through which there is a flow.

8 Claims, 9 Drawing Sheets

DEVICE FOR SEPARATING LIQUID FROM A GAS CURRENT

BACKGROUND OF THE INVENTION

The invention is based on a device for separating liquid from a gas flow.

A device for separating liquid, in particular oil, in which a plurality of parallel-connected cyclones are provided is already known from German Patent Disclosure DE 199 12 271 A1. However, in operating states of an internal combustion engine in which a volumetric flow of blowby gas to be cleaned, coming from a crankcase ventilation system, fluctuates comparatively sharply over time, either individual cyclones or parallel-connected cyclones have a poor separating action. Oil contained in the blowby gas from the crankcase ventilation system, however, must be reliably separated if a high oil loss is to be avoided, since the blowby gas is mixed with an intake flow in an intake tube of the engine, and oil contained in the blowby gas would thus be combusted in the engine. Moreover, oil contained in the blowby gas can also damage components of the engine, such as hot-film manometers, turbochargers, charge air coolers, and the lambda sensor.

From German Patent Disclosure DE 197 00 733 A1, it is known that nonwoven fabrics, knitted wire goods, wire wool, yarns or granulates can be used to separate liquid, especially oil, in a fine separator. Over the course of time, however, these materials become clogged, so that they must be replaced at predetermined intervals.

In German Patent Application 102 47 123, which had not yet been published by the priority date of the present application, a device for separating liquid that has parallel-connected spirals and coils has already been proposed. A high degree of separation with a low pressure loss can be attained only at an optimal operating point and at a predetermined volumetric flow. The volumetric flow of blowby gas is dependent on the operating state and rpm of the engine, on production tolerances between the piston and cylinder of the engine, and on wear between the piston and cylinder. The volumetric flow of blowby gas therefore varies sharply during engine operation. As a result, the device operates only rarely at its optimal operating point, and hence the degree of separation is lower, compared to the optimal operating point.

SUMMARY OF THE INVENTION

The device of the invention for separating liquid from a gas flow having the definitive characteristics of the body of the main claim has the advantage over the prior art that an improvement in the separating action is attained in a simple way by disposing at least one closing body of a distributor valve movably in a distributor conduit. The closing body cooperates with a sealing seat, so that the sealing seat seals off the crankcase from the intake tube when the engine is stopped. In this way, when the engine is stopped, gas and liquid cannot get into the intake tube and become deposited on the air flow rate meter, for instance. Liquid deposited on the air flow rate meter causes incorrect measurement values and thus an incorrectly adjusted combustion process and poor exhaust gas values. That is averted here, since when there is no or only a slight gas flow, the closing body rests on the sealing seat.

It is especially advantageous that the distributor valve controls the number of separator elements through which there is a flow, as a function of the quantity of the volumetric flow of blowby gas. This is done by providing that the closing body can open or close the separator elements, for instance in successive stages. Each stage is assigned at least one separator element. At a low volumetric flow of blowby gas, fewer separator elements have a flow through them than at a high volumetric flow of blowby gas. In this way, the separator elements can operate in an operating range around the optimal operating point and nevertheless achieve a good separating action.

It is also advantageous if the closing body adjusts automatically on the basis of a force equilibrium of a flow force exerted by the gas flow on the closing body and a force due to weight originating in the weight of the closing body, or on the basis of a force equilibrium of a flow force exerted by the gas flow on the closing body and a restoring force, for instance a spring force exerted by a spring, since that is an especially simple embodiment.

It is advantageous to embody the closing body cylindrically, spherically, conically or in flap form, since these embodiments are especially suitable in terms of the pressure loss of the gas stream in the device.

It is very advantageous if the closing body executes a linear motion, since this is especially simple to achieve in terms of engineering.

It is also advantageous if the closing body executes a rotary motion, since this is especially space-saving.

It is also advantageous to use spirals, coils, cyclones, nonwovens or yarns as separator elements. If spirals, coils and cyclones are used as separator elements, this has the advantage that they are operated closer to the optimal operating point than in the prior art. If nonwovens and yarns are used as separator elements, this has the advantage that the intervals between required replacements of the nonwovens or yarns are markedly longer than in the prior art. Under some circumstances, it may not even be necessary to replace them at all over the expected useful life of the motor vehicle.

It is advantageous if at least some of the separator elements have a different geometry, since in this way the operating range around the optimal operating point is especially wide.

It is furthermore advantageous if the distributor conduit communicates at least indirectly with the separator elements via connecting conduits, because in this way the gas is distributed centrally to the parallel-connected separator elements via the distributor conduit.

BRIEF DESCRIPTION OF THE DRAWINGS

Exemplary embodiments of the invention are shown in simplified form in the drawing and described in further detail in the ensuing description.

DETAILED DESCRIPTION OF THE PREFERRED EMBODIMENTS

Figure 1:
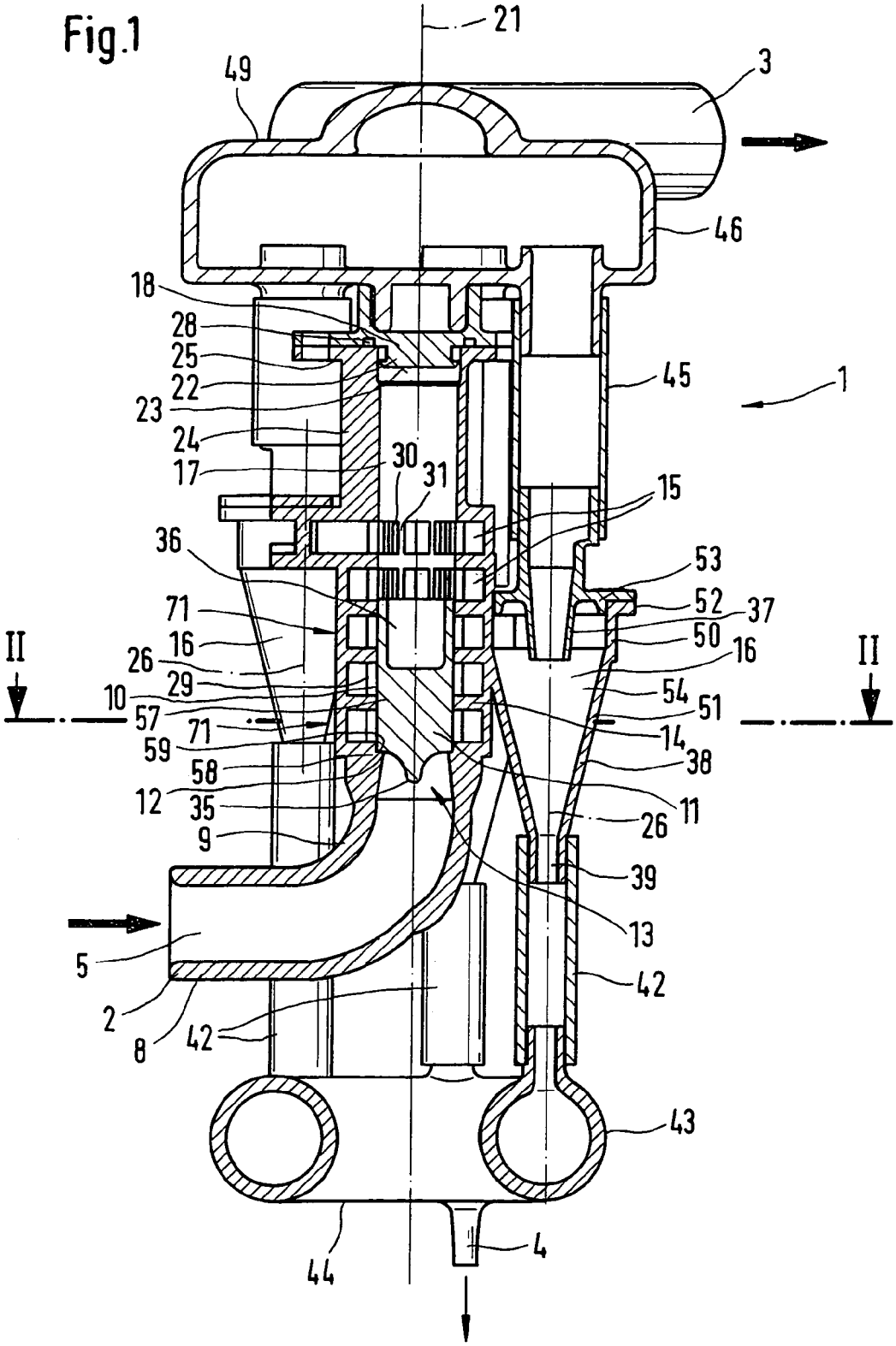
FIG. 1 shows a first view of a first exemplary embodiment of the device for separating liquid from a gas flow in section.

FIG. 1 shows a device according to the invention for separating liquid from a gas flow. The device according to the invention is preferably used to separate liquids, especially oil, from a gas flow and can thus generally be used for separating out droplets of liquids from flowing gases. The device of the invention is preferably used in a crankcase ventilation system of an internal combustion engine.

During operation of an internal combustion engine, because there is a slight leakage between a piston, piston rings, and cylinder running faces, a gas flows out of a combustion chamber into a crankcase. This gas is known as blowby gas. For the blowby gas, only the general term "gas" will be used below. Because of the slight leakage of gas from the engine combustion chamber, an excessive pressure increase occurs in the crankcase, making it necessary to achieve a pressure equilibrium by means of the so-called crankcase ventilation system. Since the gas has a high hydrocarbon concentration, the gas cannot be simply vented into the atmosphere. The crankcase ventilation system therefore carries in the form of a gas flow into an intake system of the engine, so that it will be delivered there for combustion. As a result of the gas flowing in at a high flow velocity, and because of the moving parts in the crankcase, an oil mist with many small and large oil droplets occurs in the crankcase. These oil droplets must be separated out in the crankcase ventilation system with the aid of a device for separating liquid from the gas flow, in order to prevent a high oil loss and in order not to adversely affect the combustion.

The device for separating liquid from the gas flow has a housing 1 with an inlet connection 2, a gas outlet 3, and a liquid outlet 4. The inlet connection 2 and the liquid outlet 4 communicate at least indirectly with the crankcase, not shown, of the engine, and the gas outlet 3 communicates at least indirectly with an intake tube of the engine. The inlet connection 2 of the housing 1 has an inlet conduit 5, which makes a 90° deflection, for instance after a straight conduit portion 8, at a curved portion 9 and then discharges into a straight distributor conduit 10. The cross section of the inlet conduit 5 and of the distributor conduit 10 is circular, for instance. A closing body 11 is movably supported in the distributor conduit 10 and cooperates with a sealing seat 12, disposed in the distributor conduit 10 near an end, toward the distributor conduit 10, of the curved portion 9. The closing body 11 and the sealing seat 12 form a distributor valve 13. The distributor conduit 10 narrows from the end, toward the distributor conduit 10, of the curved portion 9, in the direction of the sealing seat 12. If the closing body 11 is resting on the sealing seat 12, then the distributor conduit 10 is sealed off tightly from the inlet conduit 5. The closing body 11 is embodied cylindrically, for instance, but can also be embodied spherically, conically, or as a flap. Downstream of the sealing seat 12, in a wall 14 of the distributor conduit 10, there are a plurality of annular conduits 15 extending annularly around the circumference of the distributor conduit 10 and spaced apart from one another in the flow direction. The annular conduits 15 have a rectangular cross section, for instance. The annular conduit 15 and distributor conduit 10 are each separated from one another by an annular partition 29, each of which has many openings 30. The openings 30 are for instance rectangular. However, they can also be round, oval, or polygonal. Between the individual openings 30, a web 31 of the partition 29 remains. Each annular conduit 15 discharges into a respective connecting conduit 32 (FIG. 2), which in turn communicates with a respective separator element 16. At least one separator element 16, and for instance one separator element 16, is associated with each annular conduit 15. However, it is also possible for one annular conduit 15 to be connected to a plurality of separator elements 16, for instance two of them. The number of separator elements 16 associated with the annular conduits 15 can vary from one annular conduit 15 to an arbitrary number. For instance, the lowermost annular conduit 15 can communicate with two separator elements 16, the annular conduit 15 above it can communicate with one separator element 16, and the next higher annular conduit can communicate with three separator elements.

The separator elements 16 provided in the device are cyclones, for example, but can also be spirals, coils, nonwovens, or yarns. In the device, it is possible for instance to provide only cyclones or only spirals or coils or only nonwovens or yarns. However, a combination of the aforementioned separator elements 16, such as cyclones and spirals, is also possible.

The diameter of the closing body 11 is slightly less than that of the distributor conduit 10, so that a clearance fit exists, and the closing body 11 is guided movably in the distributor conduit 10 so that it cannot become canted. The surface of the closing body 11 for instance has numerous annular grooves in the circumferential direction, so that a contact area between the closing body 11 and the distributor conduit 10, and thus friction, are as slight as possible. On both ends of the closing body 11, chamfers are disposed on the circumference, to prevent canting. The face end of the closing body 11 toward the sealing seat 12 has a conical tip 35, for instance, for the sake of streamlining. Thus the closing body 11 has one cylindrical region 57 and one conical region 58. A lowermost edge of the cylindrical region 57 oriented toward the sealing seat 12 will be called a control edge 59. The jacket face of the conical tip 35 is for instance curved inward. On the face end of the closing body 11 remote from the sealing seat 12, a central recess 36 is for instance provided, to reduce the weight of the closing body 11. With its circumference, the closing body 11 can cover all or some of the openings 30 to an annular conduit 15 or a plurality of annular conduits 15, depending on the axial length of the closing body in the distributor conduit 10.

Downstream of the last annular conduit 15 in terms of the flow direction, the distributor conduit 10 discharges into a blind conduit 17, which is closed on its end by a flangelike cap 18. The distributor conduit 10 and the blind conduit 17 are located on the same straight axis 21. The cross sections of the distributor conduit 10 and the blind conduit 17 are the same size. The flangelike cap 18 for instance has a cylindrical shoulder 22, which is disposed centrally on the side toward the distributor conduit 10 and which engages the inside of the blind conduit 17.

The closing body 11 can move, with its end toward the blind conduit 17, as far as a face end of the cylindrical shoulder 22 oriented toward the blind conduit 17. Thus the face end forms a stop 23. The length of the blind conduit 17 is designed such that the closing body 11 can plunge far enough into the blind conduit 17 that all the openings 30 to the annular conduits 15 are completely opened. At the end of the blind conduit 17, on a wall 24 of the blind conduit 17, a shoulder 25 is provided that is complementary to the flangelike cap 18. The flangelike cap 18 is flanged to the shoulder 25 of the housing 1 with screws, for instance, but it can also be glued, welded or clipped to it. An annular sealing groove 28 is disposed in the face end of the cap 18 toward the blind conduit 17, near and outside the cylindrical shoulder 22, and in it a sealing ring, for instance, is provided for sealing off the device from the environment. Alternatively, however, a sealing groove 28 can be provided on the circumference of the cylindrical shoulder 22.

The separator elements 16 are disposed for instance concentrically around the distributor conduit 10 (FIG. 2) and ascending helically in a direction of rotation around the distributor conduit 10. Thus the separator elements are axially displaced relative to one another with respect to the axis 21. The device has at least two and for instance five separator elements 16.

The lowermost separator element 16 communicates with the lowermost annular conduit 15 via the associated connecting conduit 32. The separator element 16 next following it axially with respect to the axis 21 communicates with the annular conduit 15 above the lowermost annular conduit 15. In this way, all the separator elements 16 are assigned an annular conduit 15 in ascending order.

The cyclones 16 each have an axis of symmetry 26, which extends parallel to the axis 21 of the distributor conduit 10.

The blowby gas from the crankcase flows into the inlet conduit 5 via the inlet connection 2 of the device with a volumetric flow predetermined by the differential pressure between the crankcase and the intake tube of the engine, and when the closing body 11 is lifted from the sealing seat 12, it reaches the distributor conduit 10. The gas stream is distributed from the central distributor conduit 10 to at least one separator element 16, or to some of the parallel-connected separator elements 16.

Beyond a minimum pressure in the crankcase, the closing body 11 lifts from the sealing seat 12 and moves in the direction of the stop 23. An axial position of the closing body 11 is established in accordance with a force equilibrium of the force due to weight of the closing body 11 that is oriented downward in the direction of the sealing seat 12 and the flow force, oriented upward counter to the force due to weight and exerted on the closing body by the gas flow. If no flow is occurring, then the flow forces are equal to zero, and the closing body drops downward by its own weight onto the sealing seat 12. The minimum pressure in the crankcase beyond which the closing body 11 lifts from the sealing seat 12 is adjusted or set by way of selecting a certain weight for the closing body 11. The closing body 11 functions like a float.

The annular conduits 15, which are located between the sealing seat 12 and the control edge 59 of the closing body 11 and whose openings 30 are now no longer completely closed by the circumferential surface of the closing body 11, can experience a flow through them of the blowby gas in the direction of the separator elements 16.

Through a small gap between the distributor conduit 10 and the closing body 11, leakage can occur, so that gas in small quantities can also reach annular conduits 15 above the control edge 59.

In this way, the closing body 11 controls the number of separator elements 16 experiencing a flow through them. If the pressure in the crankcase and thus the gas flow increase, the closing body 11 moves farther upward in the direction of the stop 23 in accordance with a force equilibrium, so that the openings 30 of previously closed annular conduits 15 are opened, and additional separator elements 16 experience a flow. If the volumetric flow drops, the closing body 11 moves downward again in the direction of the sealing seat 12 in accordance with the force equilibrium, so that the openings 30 of previously opened annular conduits 15 are closed, and there is no longer a flow through separator elements 16.

The variation in the number of separator elements 16 experiencing a flow is done in so-called stages 71. With each stage 71, additional separator elements 16 are activated or deactivated. In this exemplary embodiment, the stage 71 corresponds to one annular conduit 15.

The number of separator elements 16 experiencing a flow is thus adapted on an ongoing basis to the gas flow that varies over time. Because of the control of the number of separator elements 16 experiencing a flow, the separator elements 16 can operate closer to the optimal operating point compared to the prior art and have a markedly improved separating performance than if all the separator elements 16 experienced an equal flow through them regardless of the volumetric flow.

Via the open annular conduits 15, the gas reaches the connecting conduits 32, in which the flow is accelerated. From there, the gas flows at a tangent into the separator elements 16.

In a known manner, the cyclones comprise an upper cylindrical portion 50 and a lower conical portion 51; the latter merges with a cylindrical liquid outlet 39. The cylindrical portion 50, on the side remote from the conical portion 51, has a shoulder 52 extending over the circumference. A cap 53 closes the open cylindrical portion 50 on the side toward the shoulder 52. The cap 53 rests on the shoulder 52. An immersion conduit 37 is disposed centrally on the cap 53. The immersion conduit 37 penetrates the cap 53 and with part of its length extends into an interior 54 of the cyclone 16, while with another part of its length it fits over the cap 52 in the direction remote from the cyclone 16.

In the separator elements 16, for instance in the cyclones, the separation of the liquid from the gas flow is done in a known manner. The connecting conduit 32 discharges at a tangent into the cylindrical portion 50 of the cyclone. The flow in the cyclone is set into rotation because of the tangential inflow and flows helically in the form of an outer eddy along a cyclone wall 38 in the direction of the liquid outlet 39. Near the liquid outlet 39, the flow changes its direction and ascends as an inner eddy in the center of the outer eddy in the direction of the cap 53 and leaves the cyclone 16 by way of the immersion conduit 37. Upon the rotation in the direction of the liquid outlet 39, the flow is increasingly accelerated, so that finally, liquid contained in the gas can no longer follow the flow, and by centrifugal force the liquid strikes the cyclone wall 38. The liquid separated out in this way runs downward along the cyclone wall 38 in the form of droplets or a film of liquid. The cyclones 16 each have a liquid outlet 39 at their respective lower ends.

The separator elements 16, such as cyclones, provided in the device can have a different geometry. For instance, the last and the next-to-last separator elements 16 can be larger than the separator elements 16 disposed upstream of them. Hence the separator elements 16 need not all be the same size.

By means of an outlet line 42, each liquid outlet 39 communicates with a liquid collector 43, in which the liquid separated out in the cyclones 16 is collected. The outlet line 42 is for instance a plastic pipe, but it can also be a flexible hose. On its underside at the lowest point, the liquid collector 43 has the liquid outlet 4, which communicates at least indirectly with the crankcase and through which the collected liquid is returned into the crankcase.

The gas that has been cleaned of the liquid flows into a collection chamber 43 via the immersion conduit 37 and an outflow conduit 45. The outflow conduit 45 is for instance a plastic pipe but can also be a flexible hose. The collection chamber 46, for instance on its top side 49, has a gas outlet 3, by way of which the gas is delivered at least indirectly to the intake tube.

Cyclones must be built in vertically, in the direction of gravity, with respect to their axis of symmetry 26 if their function is to be assured.

If nonwovens or yarns are for instance used as separator elements 16, and if according to the invention a plurality of nonwovens or yarns are connected parallel, then the intervals at which the nonwovens or yarns must be replaced become longer, since more filter surface area is available compared to the prior art. Replacement of the nonwovens or yarns is for instance necessary because the nonwovens or yarns become clogged over time, and the pressure loss increases excessively. If in the device of the invention the nonwovens or yarns in the first stage 71 become increasingly clogged, a higher flow pressure builds up before the next higher stage 71; thus that stage 71 opens and experiences a flow through it. If finally it becomes clogged as well, the next following stage 71 opens. If the nonwovens or yarns of all the stages 71 have finally become clogged, then an overpressure valve can for instance be provided, which connects the inlet conduit 5 directly to the gas outlet 3, so that the gas can flow via a bypass, bypassing the separator elements 16, directly into the gas outlet 3.

The device for instance comprises plastic and is produced by injection molding.

Figure 2:
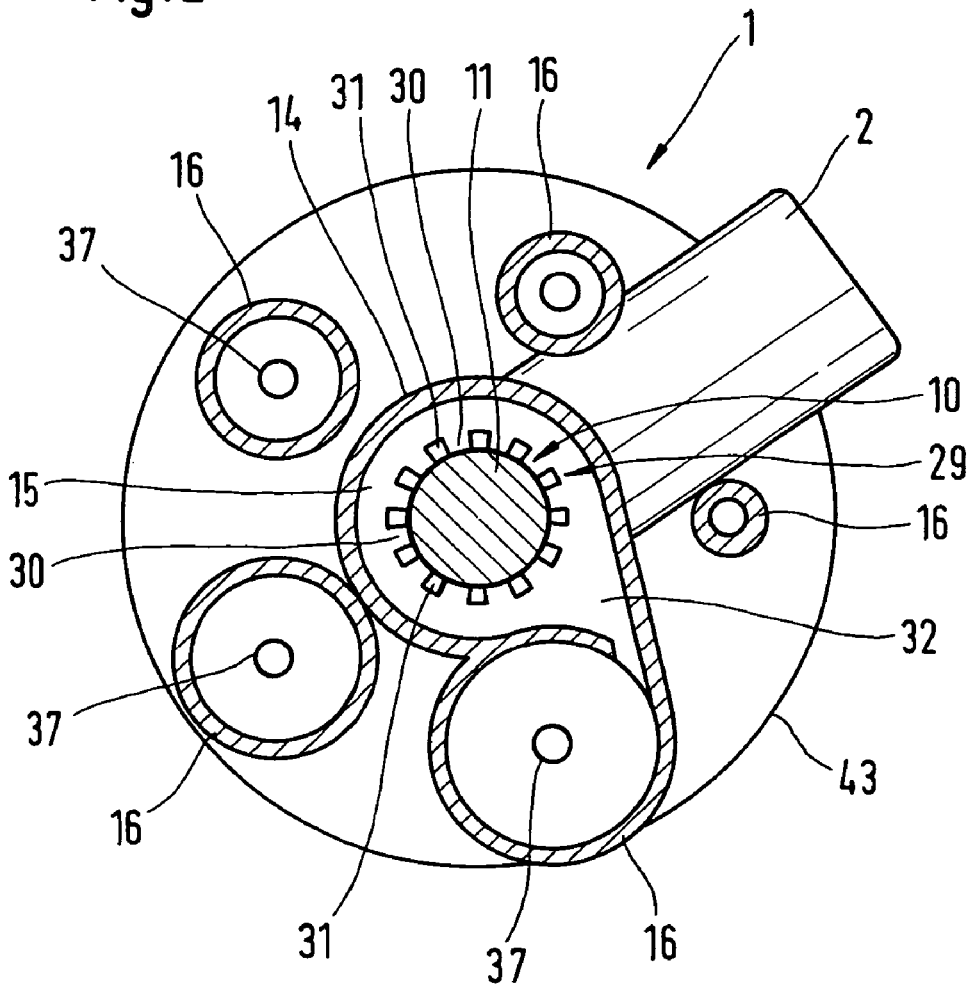
FIG. 2 shows a second view of the first exemplary embodiment in a section taken along the line II—II in FIG. 1.

FIG. 2 shows a view of the device in a section taken along the line II—II in FIG. 1.

Each connecting conduit 32 narrows, from the annular conduit 15 in the direction of the separator element 16, in order to accelerate the flow. The connecting conduits 32 discharge at a tangent into the separator elements 16.

Figure 3:
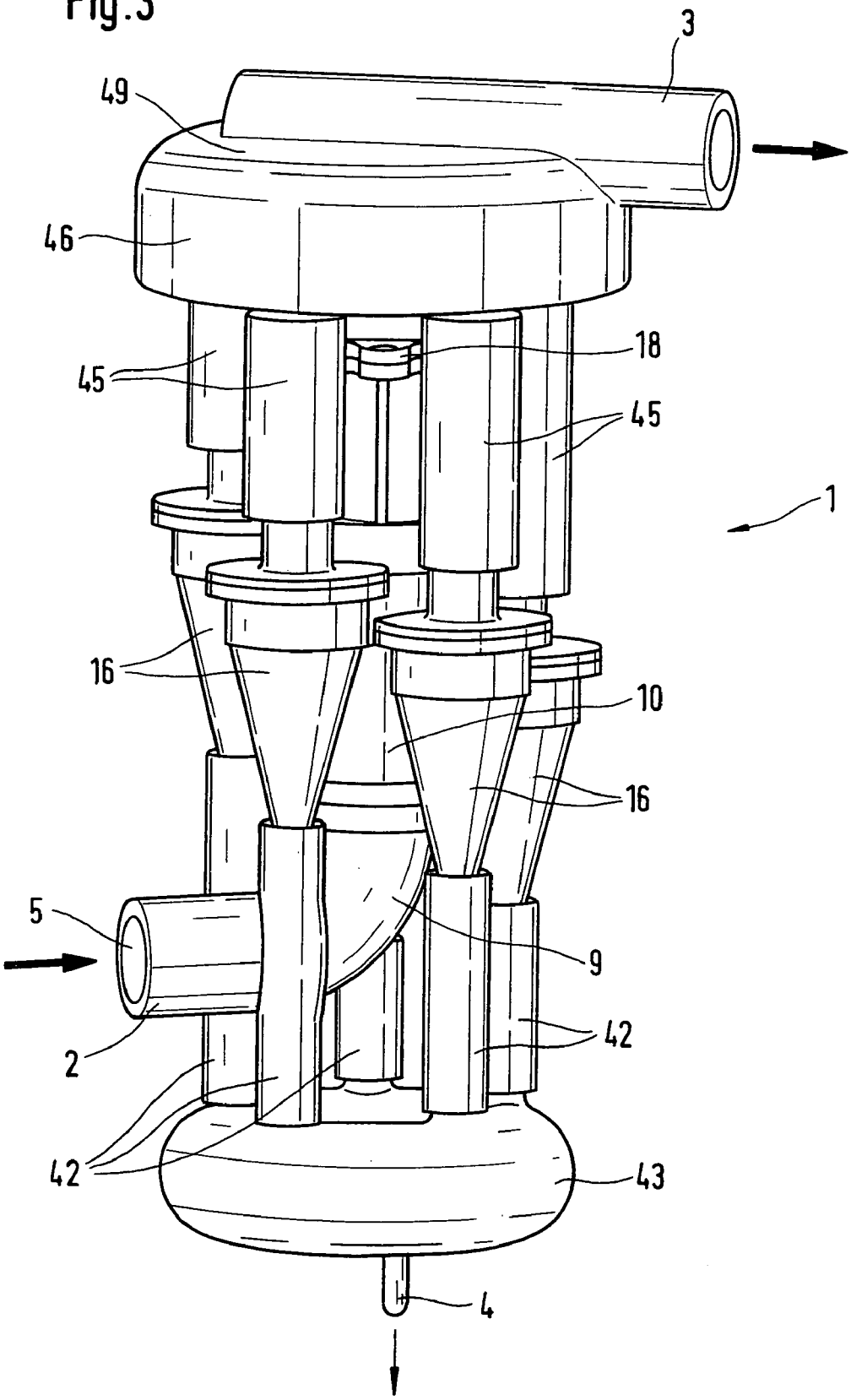
FIG. 3 shows a third view of the first exemplary embodiment.

FIG. 3 shows a further view of the device of FIG. 1.

Figure 4:
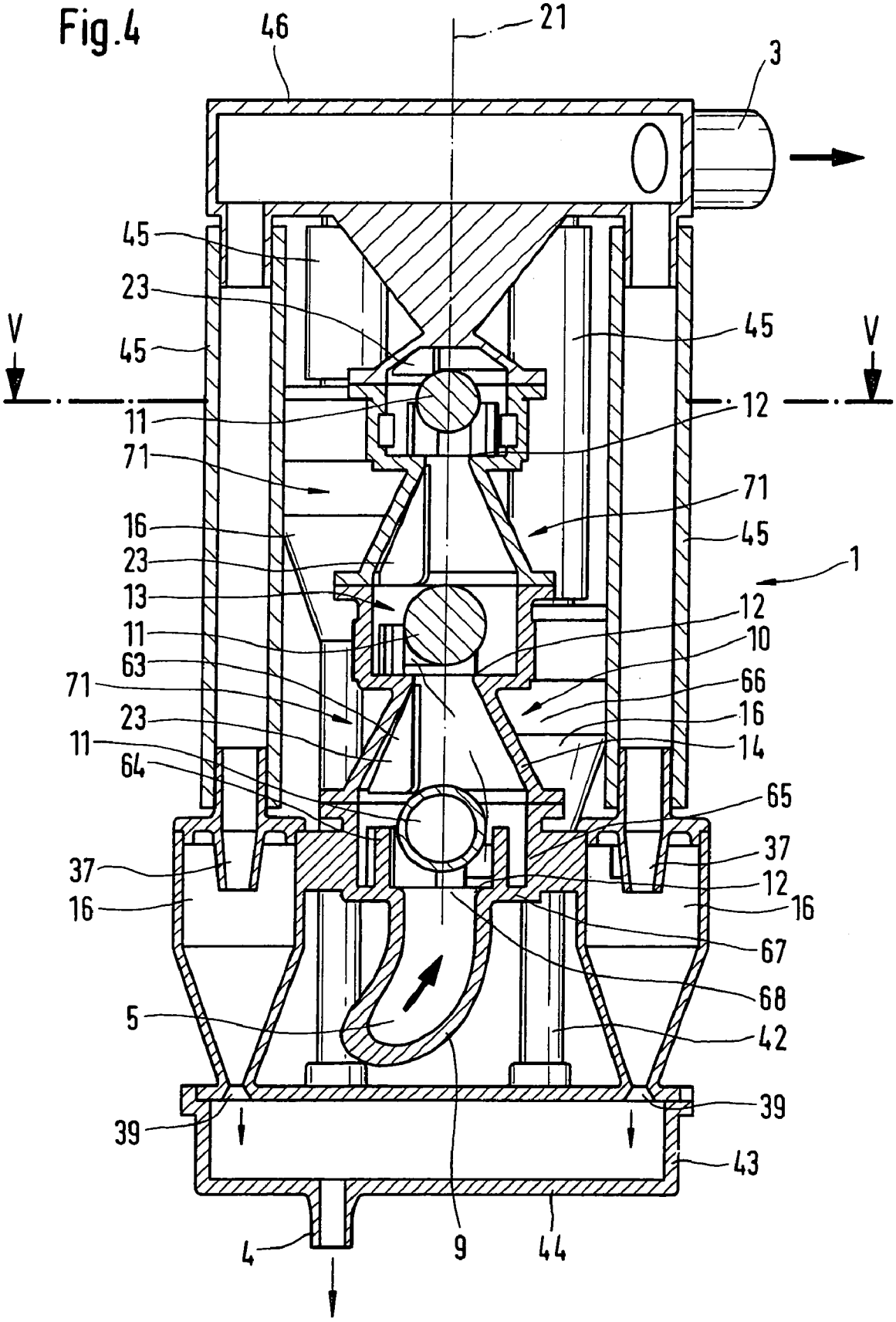
FIG. 4 is a sectional view of a second exemplary embodiment.

FIG. 4 shows a sectional view of a second exemplary embodiment.

In the device of FIG. 4, those elements that remain the same or function the same as in the device of FIGS. 1–3 are identified by the same reference numerals.

The device of FIG. 4 differs from the device of FIG. 1 in that a plurality of closing bodies 11 are provided one above the other and spaced apart axially with respect to the axis 21 in a distributor conduit 10.

The inlet conduit 5 discharges into a cup-shaped portion 65 of the distributor conduit 10. The cross section of the cup-shaped portion 65 increases abruptly compared to the inlet conduit 5. A discharge opening 68 of the inlet conduit 5 into the distributor conduit 10 is disposed in a bottom 67 of the cup-shaped portion 65. The discharge opening 68 has a circular cross section whose center point is located on the axis 21. In this exemplary embodiment, the closing body 11 is embodied spherically. In the closed state of the distributor conduit 10, the spherical closing body 11 rests on the discharge opening 68, and one edge of the discharge opening 68, on which the closing body 11 comes to rest, forms the sealing seat 12.

The closing bodies 11 are movably supported between the sealing seat 12 and the stop 23. The stop 23 is formed by triangular plates 63, for instance two in number, which are disposed on the wall 14 of the distributor conduit 10 above the closing body 11 and point radially inward with respect to the axis 21. Because of the section taken through the device, only one plate 63 each is shown. The closing body 11 is guided by T-shaped guide ribs 64 (FIG. 5), for instance four in number, which are disposed on the bottom 67 and are diametrically opposite one another. The guide ribs 64 may, however, be embodied as cylindrical pins instead.

The closing bodies 11 together with the associated sealing seats 12 form the distributor valve 13.

Downstream of the cup-shaped portion 65, the distributor conduit 10 narrows at a conical portion 66. The cup-shaped portion 65 communicates with separator elements 16 by means of connecting conduits 32. The cup-shaped portion 65 and the conical portion 66 together with the spherical closing body 11 and the associated separator elements 16 form one stage 71. In the distributor conduit 10, a plurality of stages 71 are disposed in immediate succession, so that each conical portion 66 is adjoined by a further cup-shaped portion 65 with a further sealing seat 12. The stages 71 are disposed centrally on the axis 21.

Figure 5:
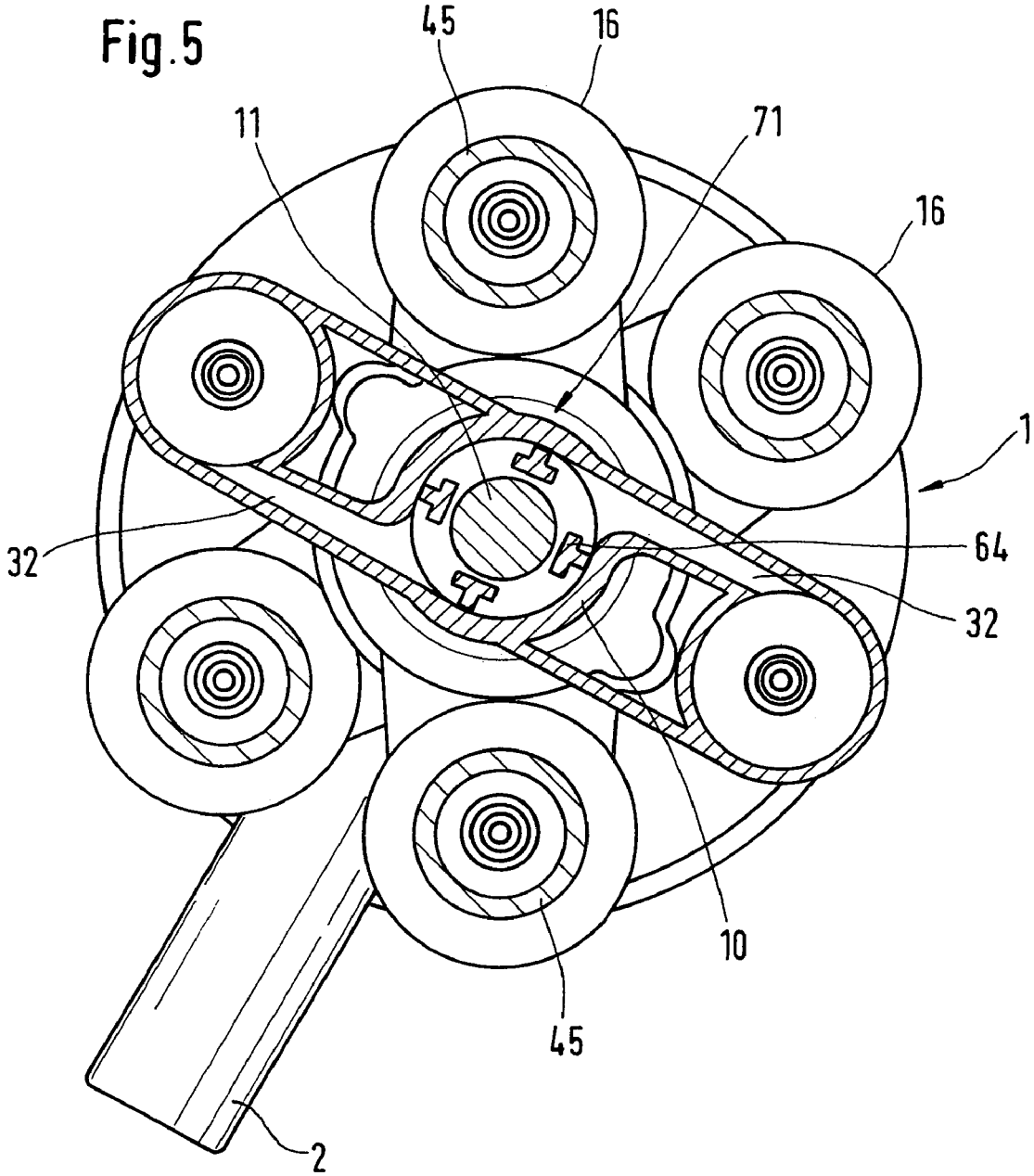
FIG. 5 shows a further view of the second exemplary embodiment in a section taken along the line V—V in FIG. 4.

In this exemplary embodiment, two separator elements 16, as shown in FIG. 5, are for instance assigned to each stage 71. From the respective cup-shaped portion 65, one connecting conduit 32 extends to each separator element 16. Thus two connecting conduits 32, for instance, originate at each stage 71 of the distributor conduit 10.

The lowermost closing body 11 is especially light in weight and is for instance hollow. As a result, the closing body 11 of the first stage 71 already lifts from the sealing seat 12 at only a slight overpressure in the crankcase, for instance immediately after the engine has started.

If the closing body 11 of the first stage 71 lifts from its sealing seat 12, the gas in the distributor conduit 10 can flow past the closing body 11 and then via the two connecting conduits 32 to the separator elements 16 of the first stage 71. If the volumetric flow is high enough, the flow backs up in the conical portion 66 and lifts the closing body 11 of the stage 71 above it as well, so that the separator elements 16 of that stage can also experience a flow. In this way, suitably many closing bodies 11 lift in a manner adapted to the gas flow, so that the number of parallel-connected separator elements 16 varies as a function of the gas flow.

The cross section of the sealing seats 12 and the diameter of the spherical closing body 11 decrease from the first stage 71 in the direction of the last stage 71.

FIG. 5, in a section taken along the line V—V, shows a further view of the second exemplary embodiment of FIG. 4.

Figure 6:
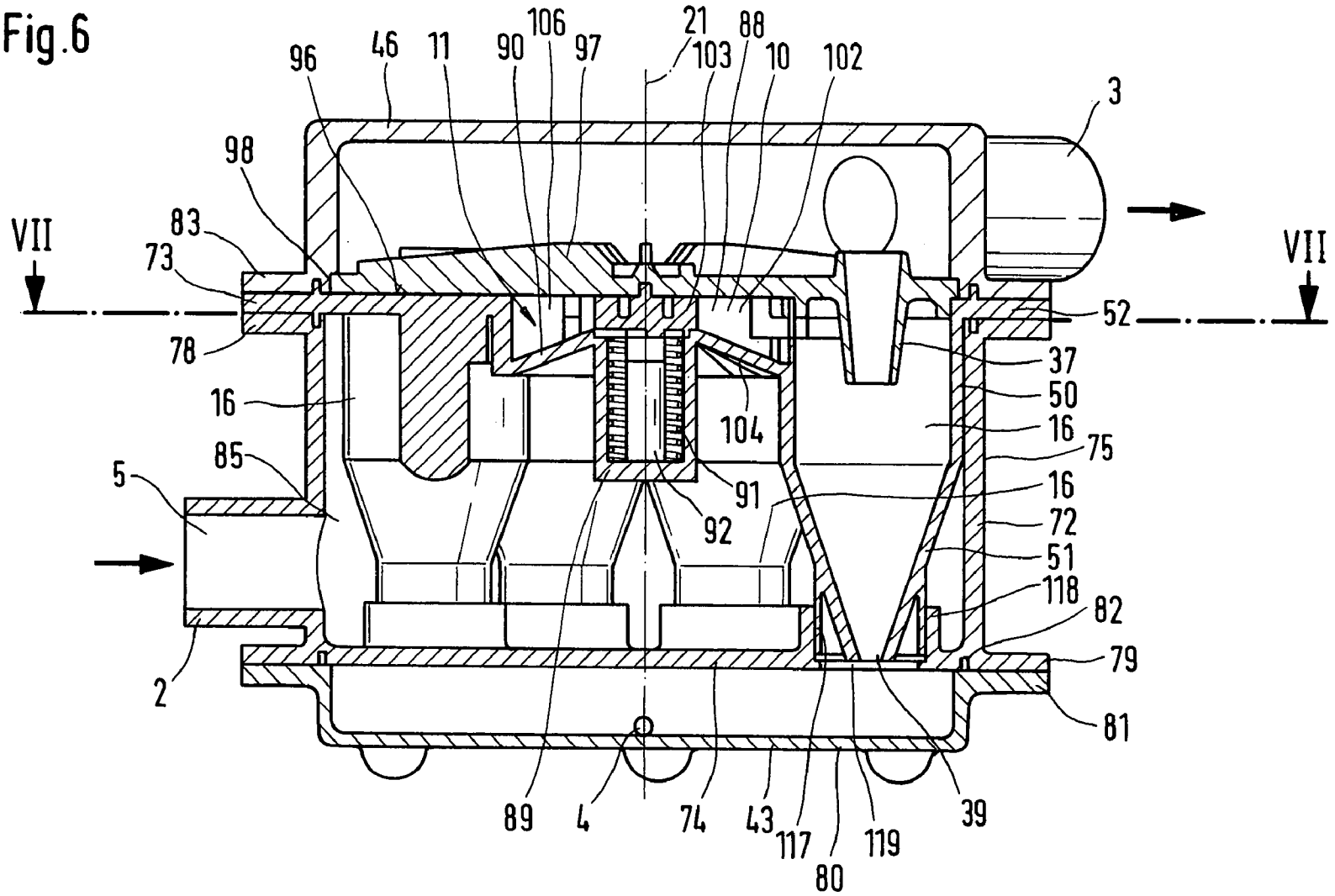
FIG. 6 is a sectional view of a third exemplary embodiment.

FIG. 6 is a sectional view of a third exemplary embodiment.

In the device of FIG. 6, those elements that remain the same or function the same as in the device of FIGS. 1–5 are identified by the same reference numerals.

The device of FIG. 6 differs from the device of FIG. 1 in that the closing body 11 is embodied in the form of a flap and is rotatably supported.

The housing 1 of the device of the invention comprises a cup-shaped middle part 72 with an inlet connection 2, a cup-shaped liquid collector 43 which is disposed below the cup-shaped middle part 72, a cup-shaped collection chamber 46 which is disposed above the cup-shaped middle part 72, and an inner part 73 which is inserted into the cup-shaped middle part 72.

The cup-shaped middle part 72 has a first bottom 74 and a cylindrical portion 75. A first flange 78 is embodied on one end of the cylindrical portion 75, and a second flange 79 is embodied on the other end, toward the first bottom 74, both flanges extending around the outer circumference. The cup-shaped liquid collector 43 is disposed on the end of the cylindrical portion 75 toward the first bottom 74. The cup-shaped liquid collector 43, with a second bottom 80, has a third flange 81, on its outer circumference on an end remote from the second bottom 80, that cooperates with the second flange 79. The flange connection between the second flange 79 of the cup-shaped middle part 72 and the third flange 81 of the liquid collector 43 is joined together by welding, screwing, or adhesive bonding, for instance.

In the first bottom 74, in the radial region of the third flange 81, a sealing groove 82 is for instance disposed, to seal off the housing 1 from the environment. The cup-shaped collection chamber 46 has a fourth flange 83, extending around its outer circumference, which cooperates with the first flange of the cup-shaped middle part 72. The flange connection between the first flange 78 of the cup-shaped middle part 72 and the fourth flange 83 of the collection chamber 46 is joined together for instance by welding, screwing or adhesive bonding.

There is also a sealing groove 82 for sealing off the device from the environment disposed in both the first flange 78 and the fourth flange 83, on the side toward the inner plate 84.

An interior 85 of the cup-shaped middle part 72 has the distributor conduit 10 and the separator elements 16; the distributor conduit 10 and the separator elements 16 are disposed on an inner plate 84 that is fastened between the first flange 78 and the fourth flange 83. The inner plate 84 has a diameter which is approximately the same as the diameter of the first flange 78.

A cylindrical receiving neck 117 is disposed concentrically on the outer circumference of the conical portion 51 and extends as far as the end of the conical portion 51 toward the first bottom 74. The receiving neck 117 cooperates with a cylindrical recess 118, which is disposed on the first bottom 74 and is engaged sealingly by the receiving neck 117 of the cyclone. An outlet opening 119 is provided in the first bottom 74, inside the cylindrical recess 118. The liquid outlet 39 communicates with the liquid collector 43 via the outlet opening 119.

The distributor conduit 10, separator elements 16 and inner plate 84 together form the inner part 73. The distributor conduit 10 is disposed centrally on the inner plate 84 relative to the axis 21, and the separator elements 16 are disposed concentrically around the distributor conduit 10. The distributor conduit 10 and the separator elements 16 are disposed such that they extend from a top side 96 of the inner plate 84 toward the interior 73 of the cup-shaped middle part 72. The distributor conduit 10 and the separator elements 16 are open toward the top side 96. A closure cap 97 is provided on the top side 96 and closes the distributor conduit 10 and the separator elements 16 off at the top. The immersion conduits 37 of the separator elements 16, which penetrate the closure cap 97 and fit over it both in the direction of the collection chamber 46 and in the direction of the interior 85, are disposed on the closure cap 97. The closure cap 97 is set on its outer circumference in an annularly encompassing shoulder 98 of the cup-shaped collection chamber 46 and is thereby fixed both axially and radially.

The inlet connection 2 is mounted, for instance in the form of a neck, on the outer circumference of the cylindrical middle part 72 and discharges into the interior 85 of the cup-shaped middle part 72. The inner part 73 with the distributor conduit 10 and the separator elements 16 are accommodated in the interior 85. The inner plate 84 of the inner part 72 divides the interior 85 from the collection chamber 46.

A cup-shaped recess 88 with a third bottom 90 is embodied in the inner plate 84. A bearing 89 is provided, in the form of a further cylindrical indentation, in the bottom 90 in the region of the axis 21. A bearing pin 92 with a helical torsion spring 91 is disposed in the bearing 89. The bearing pin 92 fits over the bearing 89 and with its length extends as far as the inside of the cup-shaped recess 88. The cup-shaped recess 88 becomes increasingly deeper radially outward steadily from the bearing 89.

By means of the bearing pin 92, a flap is rotatably supported as the closing body 11. The closing body 11 has a cylindrical portion 103, which is slipped onto the bearing pin 92 and rests with its underside on the third bottom 90. Two vanes 102, 106 are provided on the cylindrical portion 103; they are diametrically opposite one another and each originates at the cylindrical portion 103, and they extend radially outward in opposite directions. The vanes 102, 106 reach from the cylindrical portion 103 to the inside diameter of the distributor conduit 10.

Figure 7:
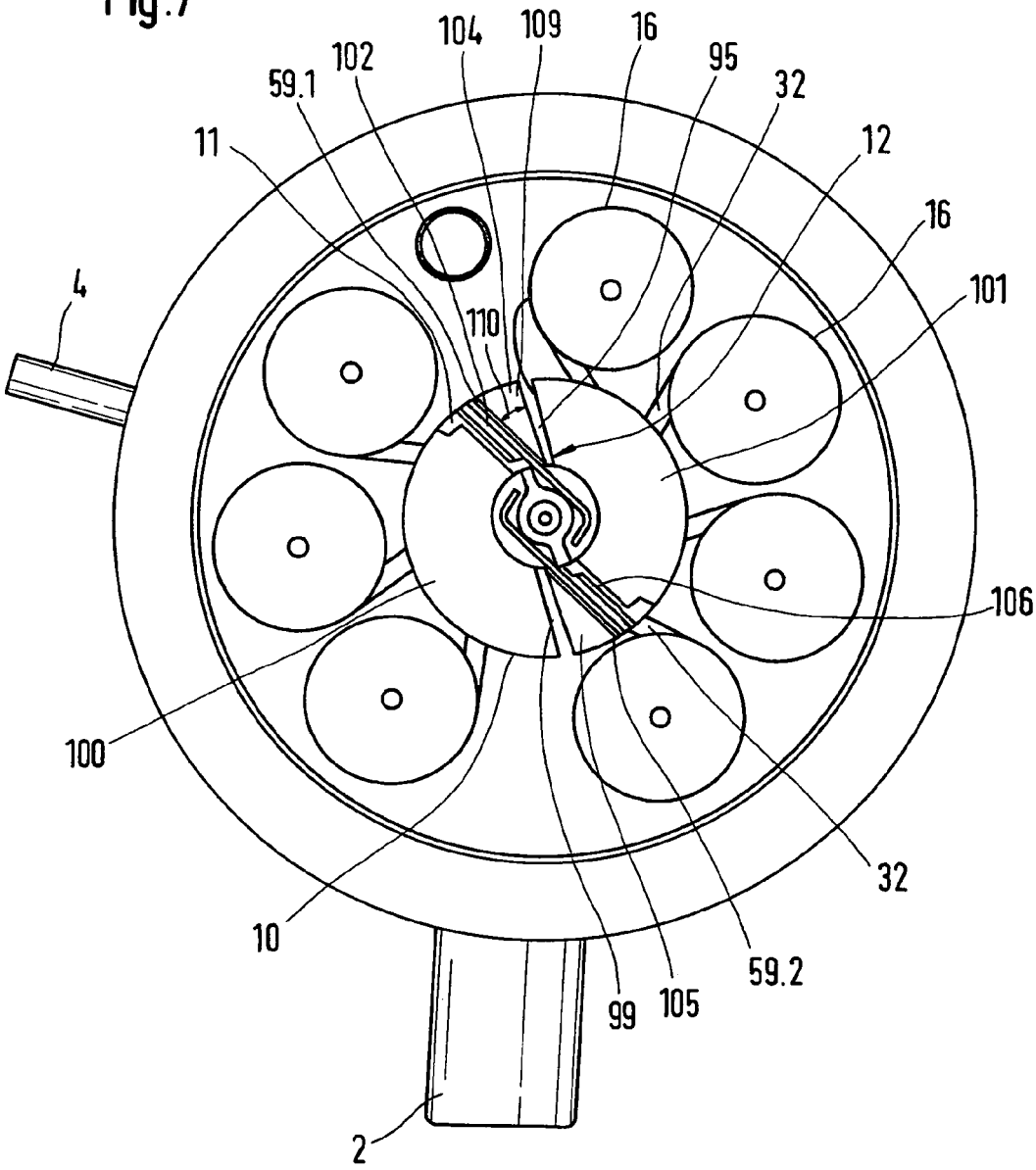
FIG. 7 shows a further view of the third exemplary embodiment in a section taken along the line VII—VII in FIG. 6.

FIG. 7, in a section taken along the line VII—VII, shown a further view of the third exemplary embodiment of FIG. 6.

FIG. 7 shows the third exemplary embodiment of the device of the invention with the distributor conduit 10 and the separator elements 16 disposed around the distributor conduit 10. The distributor conduit 10 is divided by two partitions 95, 99 into a first portion 100 and a second portion 101. The first partition 95 extends from the inside circumference of the distributor conduit 10 radially inward as far as the cylinder 103. The second partition 99 is diametrically opposite the first partition 95 and also extends from the inner circumference of the distributor conduit 10 radially inward up to the cylinder 103.

The gas flows via the inlet conduit 2 into the interior 85 and on the outside around the separator elements 16 and, via openings 104, 105, for instance two of them, disposed in the third bottom 90, into the distributor conduit 10. The first opening 104 discharges into the first portion 100, and the second opening 105 discharges into the second portion 101 of the distributor conduit. The first opening 104 and the second opening 105 are embodied in triangular form, for example, but can also be circular, oval, or polygonal. The first opening 104 is located between the first partition 95 and the first vane 102; the second opening 105 is located between the second partition 99 and the second vane 106. The area between the first partition 95 and the first vane 102 and the area between the second partition 99 and the second vane 106 each form one segment 109 of a circle. The angle between the first partition 95 and the first vane 102 and between the second partition 99 and the second vane 106 is called the indexing angle 110.

The closing body 11 can move between two terminal positions. In the outset position that forms the sealing seat 12, the first vane 102 touches the second partition 95; in the final position, the second vane 106 touches the first partition 99. The closing body 11 and the sealing seat 12 form the distributor valve 13.

The first vane 102 has a first control edge 59.1 on the circumference toward the distributor conduit 10, on the side toward the first partition 95; the second vane 106 has a second control edge 59.2 on the circumference toward the distributor conduit 10, on the side toward the second partition 99. The connecting conduits 32 are distributed for instance uniformly over the circumference of the distributor conduit 10 and extend from the circumference of the distributor conduit 10 at a tangent to the separator elements 16.

The connecting conduits 32, which are located either between the first control edge 59.1 and the first partition 95 or between the second control edge 59.2 and the second partition 99, can experience a flow through them of the blowby gas from the openings 104, 105 in the direction of the separator elements 16.

In this way, the closing body 11 controls the number of separator elements 16 through which there is a flow. If the volumetric flow increases, the closing body moves in accordance with a force equilibrium in the direction of an increasing indexing angle 110, so that further connecting conduits 32 are opened, and additional separator elements 16 have a flow through them. If the volumetric flow drops, the closing body 11 moves in accordance with a force equilibrium in the direction of a decreasing indexing angle 110, so that connecting conduits 32 are closed again, and separator elements 16 no longer have a flow through them.

The gas acts with its pressure on the vanes 102, 106 and seeks to move the closing body 11 to rotate counterclockwise, counter to a force of the torsion spring 91.

Figure 8:
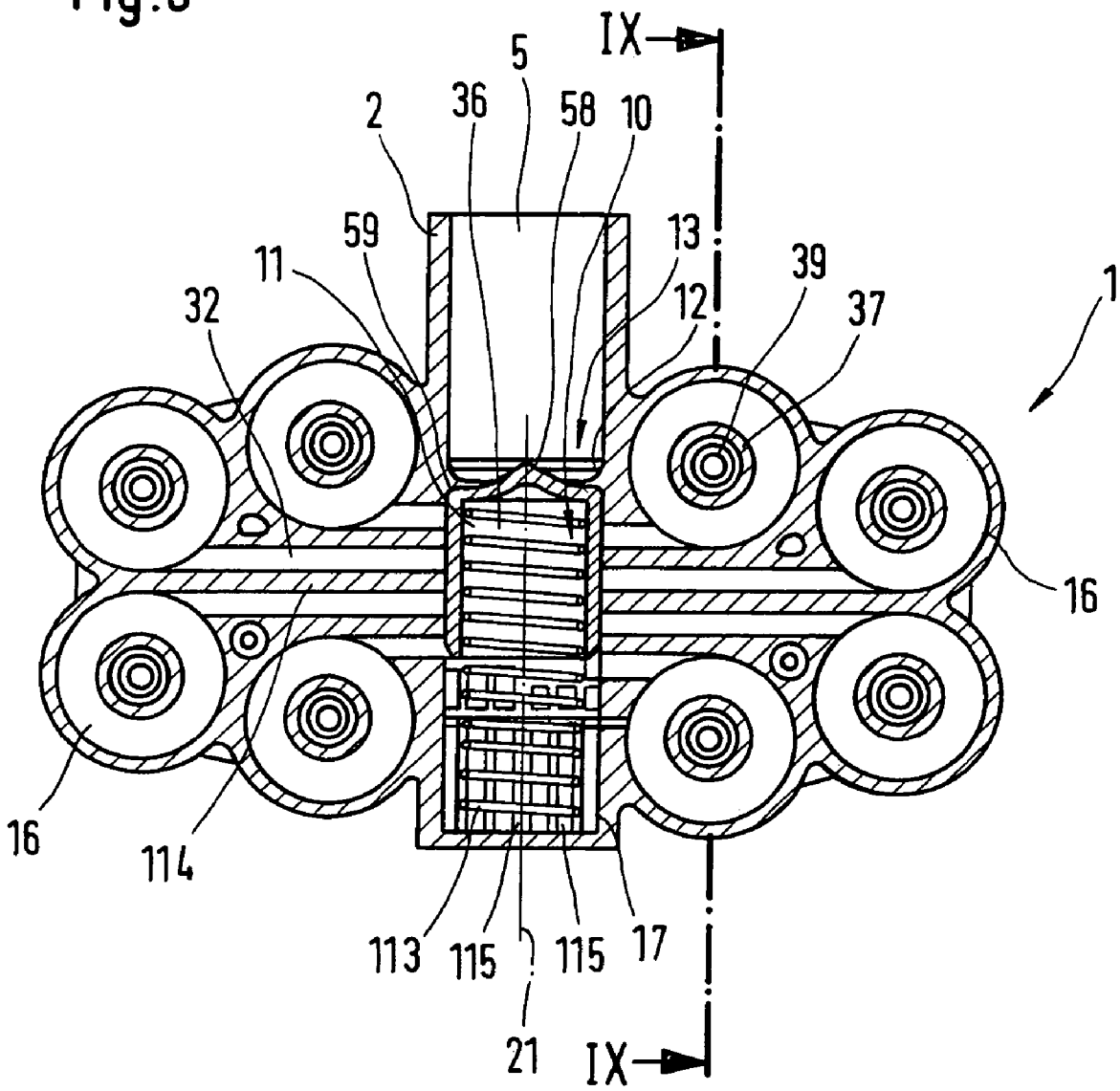
FIG. 8 is a sectional view through a fourth exemplary embodiment.

FIG. 8 shows a sectional view of a fourth exemplary embodiment.

In the device of FIG. 8, those elements that remain the same or function the same as in the device of FIGS. 1–7 are identified by the same reference numerals.

The device of FIG. 8 differs from the device of FIG. 1 in that the closing body 11 is provided in a horizontal distributor conduit 10. The closing body 11 can therefore not act as a float, since the force due to weight of the closing body 11 does not act counter to the flow force. Instead of the force due to weight, the spring force of a compression spring 113 is employed to move the closing body 11 in the direction of the sealing seat 12 counter to the flow force. It is therefore the flow force exerted by the gas on the closing body 11 and the spring force exerted by the compression spring 113 that are involved in the force equilibrium.

The closing body 11 and the sealing seat 12 form the distributor valve 13.

Figure 9:
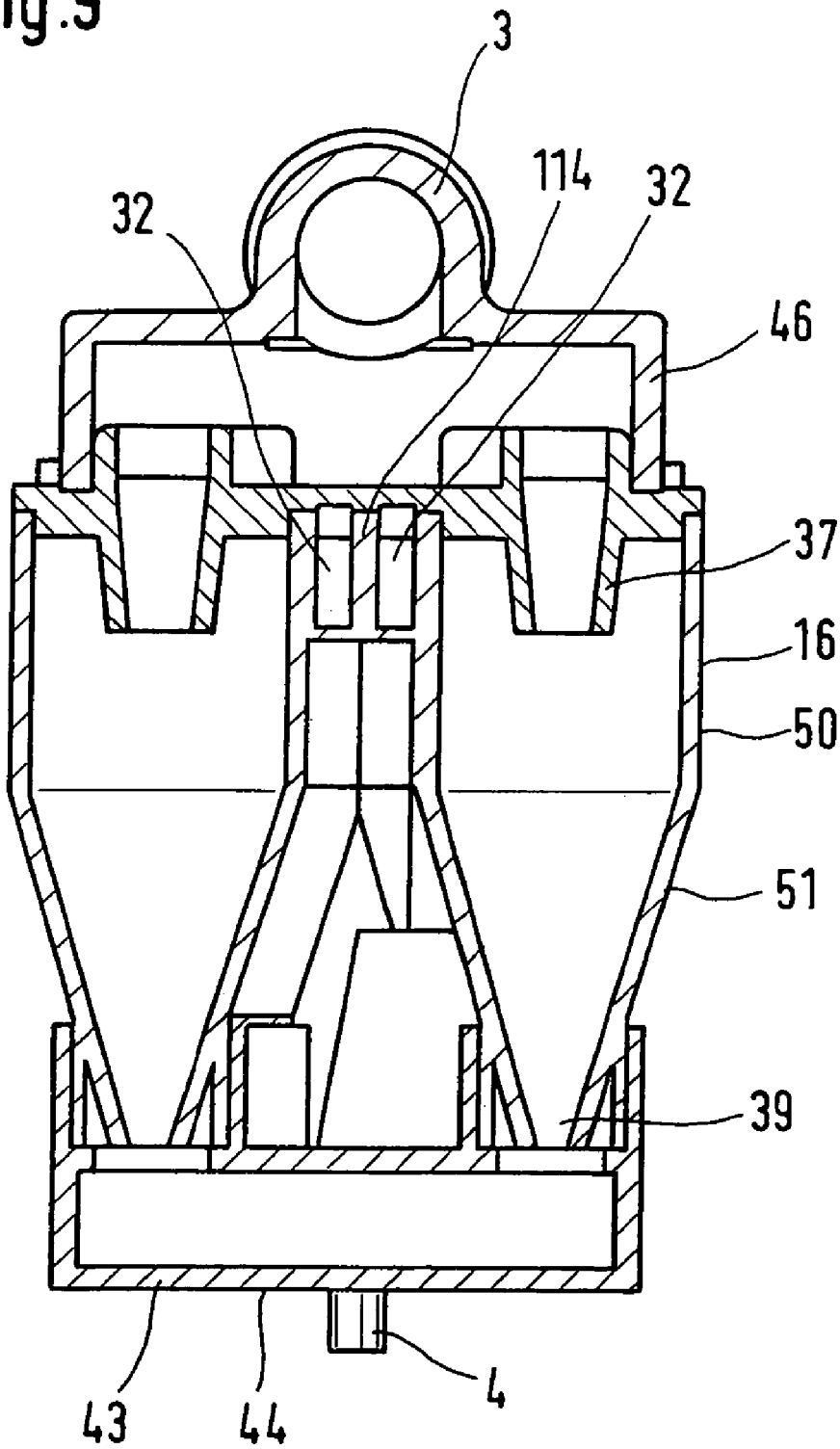
FIG. 9 shows a further view of the fourth exemplary embodiment in a section taken along the line IX—IX in FIG. 8.

In contrast to FIG. 1, no annular conduits 15 are disposed on the distributor conduit 10. Instead, connecting conduits 32 lead from the distributor conduit 10 to the separator elements 16. The connecting conduits 32 have a rectangular cross section (FIG. 9), for example, and each of them discharges at a tangent into the cylindrical portion 50 of the respect separator elements 16. A plurality of distributor conduits 32 are provided at the distributor conduit 10, downstream of the sealing seat 12 and in axial succession, each separated from the next by a respective conduit wall 14. The number of connecting conduits 32 is arbitrary. The connecting conduits 32 and the separator elements 16 are disposed for instance on two diametrically opposed sides of the distributor conduit 10. The connecting conduits 32 for instance extend rectilinearly and transversely to the axis 21. For example the connecting conduits 32 are disposed offset from one another on the diametrically opposed sides.

The blind conduit 17 has grooves 115, extending in the direction of the axis 21 and distributed for instance over the circumference. The grooves 115 reduce the area of contact and thus the friction between the distributor conduit 10 and the closing body 11. The grooves 115 also take up oil that collects at the circumference of the blind conduit 17.

The closing body 11 is embodied for instance cylindrically with the recess 36. Instead of the one cylindrical closing body 11, a plurality of flaplike closing bodies 11 are also possible.

The surface of the closing body 11 is for instance smooth.

One end of the compression spring 113 is supported in the recess 36, and the other end of the compression spring 113 is supported on the end of the blind conduit 17 remote from the sealing seat 12.

The separator elements 16 are disposed for instance in an oval at the distributor conduit 10.

What is claimed is:

1. A device for separating liquid from a gas flow in a crankcase of an internal combustion engine, comprising a housing with separator elements, characterized in that the device has a distributor valve (13), which is supported movably in a distributor conduit (10) by means of at least one closing body (11) cooperating with a sealing seat (12), wherein the distributor conduit (10) communicates with the separator elements (16) at least indirectly via connecting conduits (32).

2. The device of claim 1, wherein the gas flow can be routed to one or more separator elements (16) by the distributor valve (13) as a function of the quantity of the gas flow.

3. The device of claim 1, wherein the closing body (11) adjusts automatically on the basis of a force equilibrium of a flow force exerted by the gas flow on the closing body (11) and a force due to weight, originating in the weight of the closing body (11), and/or a spring force, exerted by a spring (91, 113).

4. The device of claim 1, wherein the closing body (11) is embodied cylindrically, spherically, conically, or in flap form.

5. The device of claim 1, wherein the closing body (11) executes a linear motion.

6. The device of claim 1, wherein the closing body (11) executes a rotary motion.

7. The device of claim 1, wherein the separator elements (16) are spirals, coils, cyclones, nonwovens, or yarns.

8. The device of claim 1, wherein at least some of the separator elements (16) have different dimensions.

* * * * *